US008615394B1

(12) United States Patent
Avendano et al.

(10) Patent No.: US 8,615,394 B1
(45) Date of Patent: Dec. 24, 2013

(54) RESTORATION OF NOISE-REDUCED SPEECH

(71) Applicants: Carlos Avendano, Campbell, CA (US); Marios Athineos, San Francisco, CA (US)

(72) Inventors: Carlos Avendano, Campbell, CA (US); Marios Athineos, San Francisco, CA (US)

(73) Assignee: Audience, Inc., Mountain View, CA (US)

( * ) Notice: Subject to any disclaimer, the term of this patent is extended or adjusted under 35 U.S.C. 154(b) by 0 days.

(21) Appl. No.: 13/751,907

(22) Filed: Jan. 28, 2013

Related U.S. Application Data

(60) Provisional application No. 61/591,622, filed on Jan. 27, 2012.

(51) Int. Cl.
*G10L 21/00* (2013.01)
*G10L 21/02* (2013.01)
*G10L 19/00* (2013.01)

(52) U.S. Cl.
USPC ..... 704/228; 704/226; 704/219

(58) Field of Classification Search
USPC ..... 704/200–257
See application file for complete search history.

(56) References Cited

U.S. PATENT DOCUMENTS

| | | | | |
|---|---|---|---|---|
| 5,978,824 | A * | 11/1999 | Ikeda | 708/322 |
| 2004/0066940 | A1* | 4/2004 | Amir | 381/94.2 |
| 2005/0261896 | A1* | 11/2005 | Schuijers et al. | 704/219 |
| 2006/0100868 | A1* | 5/2006 | Hetherington et al. | 704/226 |
| 2006/0136203 | A1* | 6/2006 | Ichikawa | 704/226 |
| 2007/0058822 | A1* | 3/2007 | Ozawa | 381/94.1 |
| 2007/0282604 | A1* | 12/2007 | Gartner et al. | 704/228 |
| 2009/0226010 | A1* | 9/2009 | Schnell et al. | 381/119 |

* cited by examiner

*Primary Examiner* — Jesse Pullias
(74) *Attorney, Agent, or Firm* — Carr & Ferrell LLP

(57) ABSTRACT

Disclosed are methods and corresponding systems for audio processing of audio signals after applying a noise reduction procedure such as noise cancellation and/or noise suppression, according to various embodiments. A method may include calculating spectral envelopes for corresponding samples of an initial audio signal and the audio signal transformed by application of the noise cancellation and/or suppression procedure. Multiple spectral envelope interpolations may be calculated between these two spectral envelopes. The interpolations may be compared to predetermined reference spectral envelopes associated with predefined clean reference speech. One of the generated interpolations, which is the closest to one of the predetermined reference spectral envelopes, may be selected. The selected interpolation may be used for restoration of the transformed audio signal such that at least a part of the frequency spectrum of the transformed audio signal is modified to the levels of the selected interpolation.

30 Claims, 8 Drawing Sheets

RESTORATION OF NOISE-REDUCED SPEECH

CROSS REFERENCE TO RELATED APPLICATIONS

This application claims the benefit of U.S. Provisional Application No. 61/591,622, filed on Jan. 27, 2012, the disclosure of which is herein incorporated by reference in its entirety.

BACKGROUND

1. Field

The present disclosure relates generally to audio processing, and more particularly to methods and systems for restoration of noise-reduced speech.

2. Description of Related Art

Various electronic devices that capture and store video and audio signals may use acoustic noise reduction techniques to improve the quality of the stored audio signals. Noise reduction may improve audio quality in electronic devices (e.g., communication devices, mobile telephones, and video cameras) which convert analog data streams to digital audio data streams for transmission over communication networks.

An electronic device receiving an audio signal through a microphone may attempt to distinguish between desired and undesired audio signals. To this end, the electronic device may employ various noise reduction techniques. However, conventional noise reduction systems may over-attenuate or even completely eliminate valuable portions of speech buried in excessive noise, such that no or poor speech signal is generated.

SUMMARY

This summary is provided to introduce a selection of concepts in a simplified form that are further described in the Detailed Description below. This summary is not intended to identify key features or essential features of the claimed subject matter, nor is it intended to be used as an aid in determining the scope of the claimed subject matter.

Methods disclosed herein may improve audio signals subjected to a noise reduction procedure, especially those parts of the audio signal which have been overly attenuated during the noise reduction procedure.

Methods disclosed herein may receive an initial audio signal from one or more sources such as microphones. The initial audio signal may be subjected to one or more noise reduction procedures, such as noise suppression and/or noise cancellation, to generate a corresponding transformed audio signal having an improved signal-to-noise ratio. Furthermore, embodiments of the present disclosure may include calculation of two spectral envelopes for corresponding samples of the initial audio signal and the transformed audio signal. These spectral envelopes may be analyzed and corresponding multiple spectral envelope interpolations may be calculated between these two spectral envelopes. The interpolations may then be compared to predetermined reference spectral envelopes related to predefined clean reference speech and one of the generated interpolations. Based on the comparison, the closest or most similar to one of the predetermined reference spectral envelopes may be selected. The comparison process may optionally include calculation of corresponding multiple line spectral frequency (LSF) coefficients associated with the interpolations. These LSF coefficients may be matched to a set of predetermined reference coefficients associated with the predefined clean reference speech. One of the selected interpolations may be used for restoration of the transformed audio signal. In particular, at least a part of the frequency spectrum of the transformed audio signal may be modified to the level of the selected interpolation.

In further example embodiments of the present disclosure, the methods' steps may be stored on a processor-readable medium having instructions, which when implemented by one or more processors perform the methods' steps. In yet further example embodiments, hardware systems or devices can be adapted to perform the recited steps. The methods of the present disclosure may be practiced with various electronic devices including, for example, cellular phones, video cameras, audio capturing devices, and other user electronic devices. Other features, examples, and embodiments are described below.

DETAILED DESCRIPTION

Figure 1:
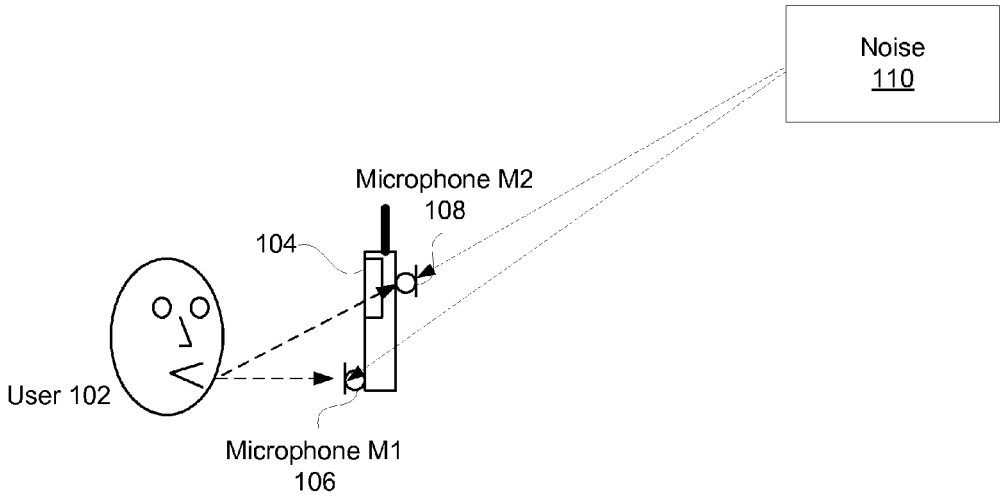
FIG. 1 illustrates an environment in which embodiments of the present technology may be practiced.

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific embodiments, it will be understood that these embodiments are not intended to be limiting.

Embodiments disclosed herein may be implemented using a variety of technologies. For example, the methods described herein may be implemented in software executing on a computer system or in hardware utilizing either a combination of microprocessors or other specially designed application-specific integrated circuits (ASICs), programmable logic devices, or various combinations thereof. In particular, the methods described herein may be implemented by a series of computer-executable instructions residing on a storage medium such as a disk drive, or computer-readable medium.

It should be noted that methods disclosed herein can be implemented by a computer, e.g., a desktop computer, tablet computer, phablet computer; laptop computer, wireless telephone, and so forth.

The present technology may provide audio processing of audio signals after a noise reduction procedure such as noise suppression and/or noise cancellation has been applied. In general, the noise reduction procedure may improve signal-to-noise ratio, but, in certain circumstances, the noise reduction procedures may overly attenuate or even eliminate speech parts of audio signals extensively mixed with noise.

The embodiments of the present disclosure allow analyzing both an initial audio signal (before the noise suppression and/or noise cancellation is performed) and a transformed audio signal (after the noise suppression and/or noise cancellation is performed). For corresponding frequency spectral samples of both audio signals (taken at the corresponding times), spectral envelopes may be calculated. Furthermore, corresponding multiple spectral envelope interpolations or "prototypes" may be calculated between these two spectral envelopes. The interpolations may then be compared to predetermined reference spectral envelopes related to predefined clean reference speech using a gradual examination procedure, also known as morphing. Furthermore, based on the results of the comparison, a generated interpolation which is the closest or most similar to one of the predetermined reference spectral envelopes, may be selected. The comparison process may include calculation of corresponding multiple LSF coefficients associated with the interpolations. The LSF coefficients may be matched to a set of predetermined reference coefficients associated with the predefined clean reference speech. The match may be based, for example, on a weight function. When the closest interpolation (prototype) is selected, it may be used for restoration of the transformed, noise-suppressed audio signal. At least part of the frequency spectrum of this signal may be modified to the levels of the selected interpolation.

FIG. 1 is an example environment in which embodiments of the present technology may be used. A user 102 may act as an audio (speech) source to an audio device 104. The example audio device 104 may include two microphones: a primary microphone 106 and a secondary microphone 108 located a distance away from the primary microphone 106. Alternatively, the audio device 104 may include a single microphone. In yet other example embodiments, the audio device 104 may include more than two microphones, such as for example three, four, five, six, seven, eight, nine, ten or even more microphones. The audio device 104 may include or be a part of, for example, a wireless telephone or a computer.

The primary microphone 106 and secondary microphone 108 may include omni-directional microphones. Various other embodiments may utilize different types of microphones or acoustic sensors, such as, for example, directional microphones.

While the primary and secondary microphones 106, 108 may receive sound (i.e., audio signals) from the audio source (user) 102, these microphones 106 and 108 may also pick noise 110. Although the noise 110 is shown coming from a single location in FIG. 1, the noise 110 may include any sounds from one or more locations that differ from the location of audio source (user) 102, and may include reverberations and echoes. The noise 110 may include stationary, non-stationary, and/or a combination of both stationary and non-stationary noises.

Some embodiments may utilize level differences (e.g. energy differences) between the audio signals received by the two microphones 106 and 108. Because the primary microphone 106 may be closer to the audio source (user) 102 than the secondary microphone 108, in certain scenarios, an intensity level of the sound may be higher for the primary microphone 106, resulting in a larger energy level received by the primary microphone 106 during a speech/voice segment.

The level differences may be used to discriminate speech and noise in the time-frequency domain. Further embodiments may use a combination of energy level differences and time delays to discriminate between speech and noise. Based on such inter-microphone differences, speech signal extraction or speech enhancement may be performed.

Figure 2:
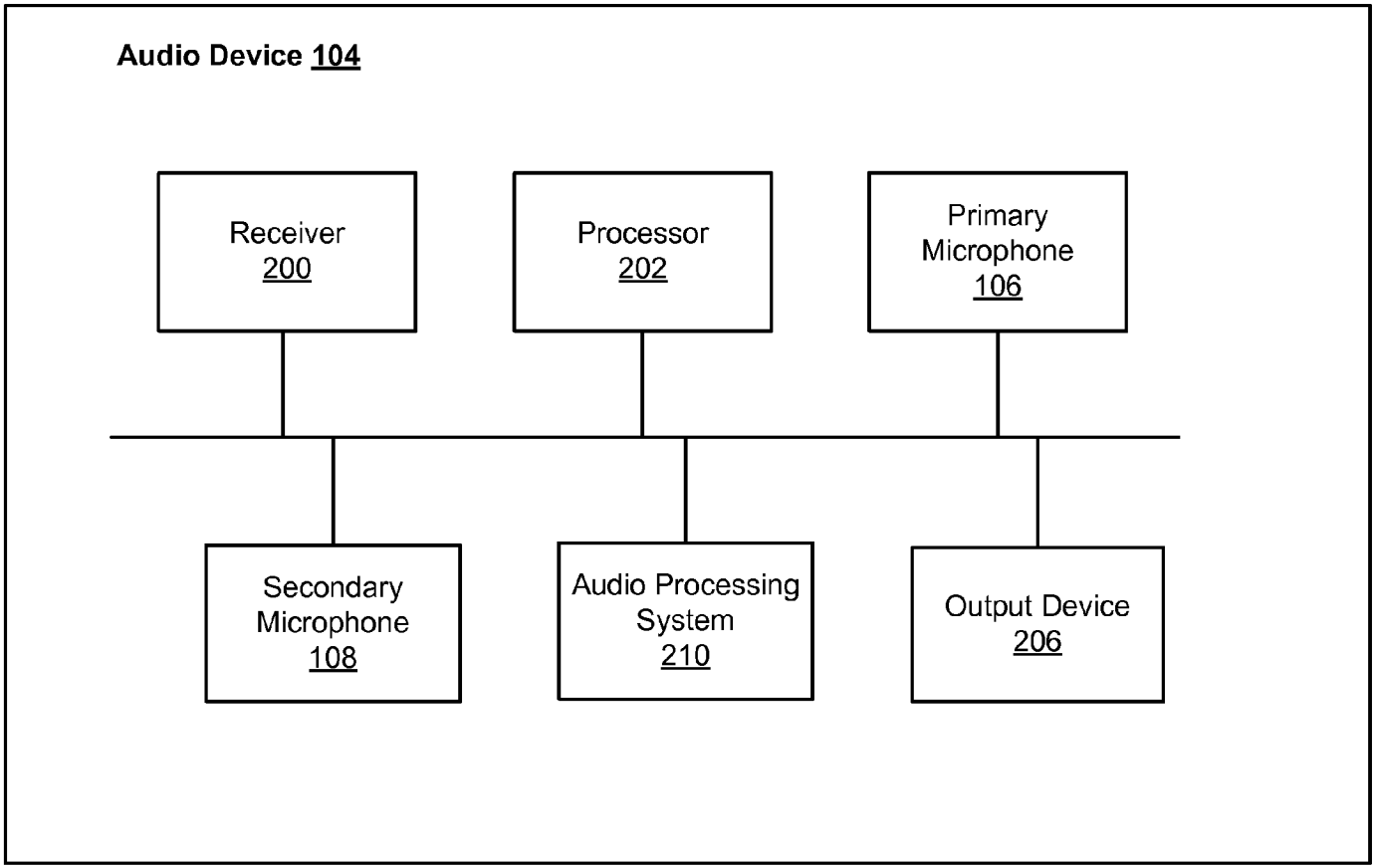
FIG. 2 is a block diagram of an example electronic device.

FIG. 2 is a block diagram of an example audio device 104. As shown, the audio device 104 may include a receiver 200, a processor 202, the primary microphone 106, the optional secondary microphone 108, an audio processing system 210, and an output device 206. The audio device 104 may include further or different components as needed for audio device 104 operations. Similarly, the audio device 104 may include fewer components that perform similar or equivalent functions to those depicted in FIG. 2.

The processor 202 may execute instructions and modules stored in a memory (not illustrated in FIG. 2) in the audio device 104 to perform various functionalities described herein, including noise reduction for an audio signal. The processor 202 may include hardware and software implemented as a processing unit, which may process floating point operations and other operations for the processor 202.

The example receiver 200 may include an acoustic sensor configured to receive or transmit a signal from a communications network. Hence, the receiver 200 may be used as a transmitter in addition to being used as a receiver. In some example embodiments, the receiver 200 may include an antenna. Signals may be forwarded to the audio processing system 210 to reduce noise using the techniques described herein, and provide audio signals to the output device 206. The present technology may be used in the transmitting or receiving paths of the audio device 104.

The audio processing system 210 may be configured to receive the audio signals from an acoustic source via the primary microphone 106 and secondary microphone 108 and process the audio signals. Processing may include performing noise reduction on an audio signal. The audio processing system 210 is discussed in more detail below.

The primary and secondary microphones 106, 108 may be spaced a distance apart in order to allow for detecting an energy level difference, time difference, or phase difference between audio signals received by the microphones. The audio signals received by primary microphone 106 and secondary microphone 108 may be converted into electrical signals (i.e. a primary electrical signal and a secondary electrical signal). The electrical signals may themselves be converted by an analog-to-digital converter (not shown) into digital signals for processing in accordance with some example embodiments.

In order to differentiate the audio signals, the audio signal received by the primary microphone 106 is herein referred to as a primary audio signal, while the audio signal received from by the secondary microphone 108 is herein referred to as a secondary audio signal. The primary audio signal and the secondary audio signal may be processed by the audio processing system 210 to produce a signal with an improved signal-to-noise ratio. It should be noted that embodiments of the technology described herein may, in some example embodiments, be practiced with only the primary microphone 106.

The output device 206 is any device which provides an audio output to the user. For example, the output device 206 may include a speaker, a headset, an earpiece of a headset, or a speaker communicating via a conferencing system.

Figure 3:
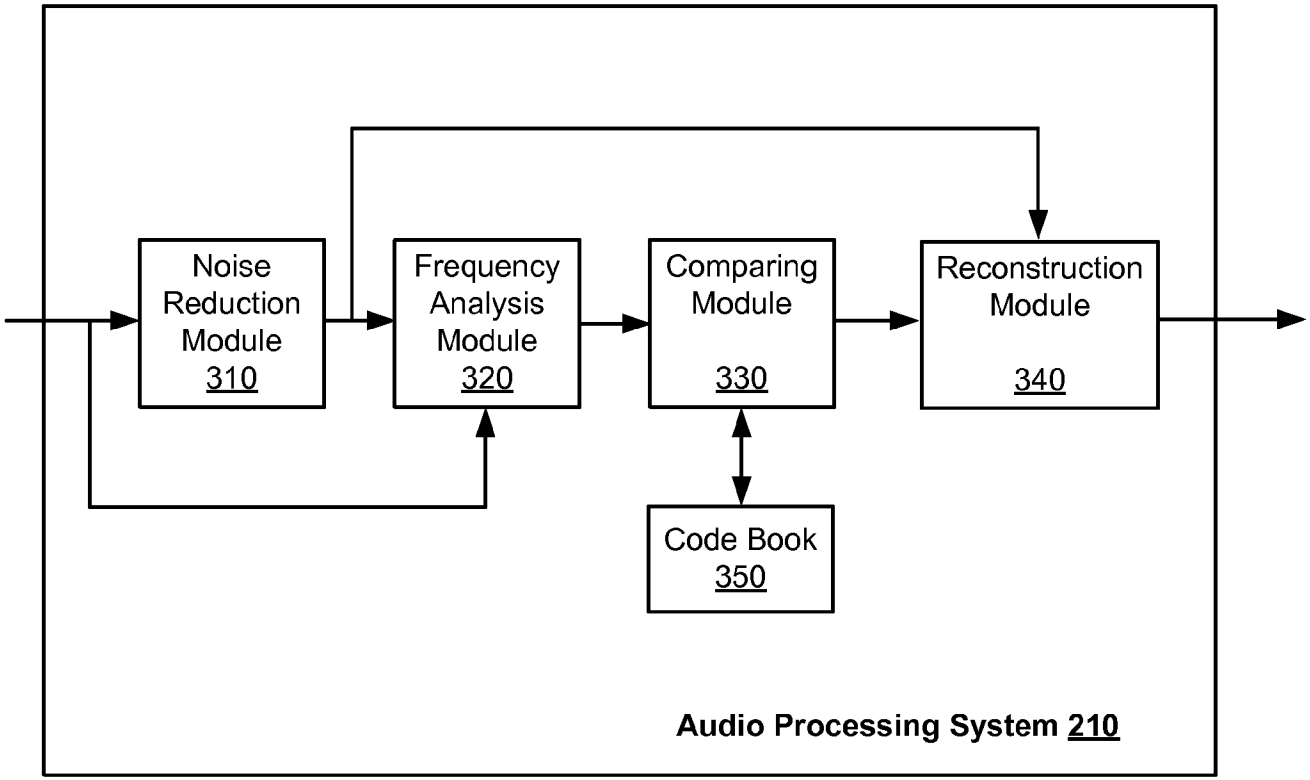
FIG. 3 is a block diagram of an example audio processing system according to various embodiments.

FIG. 3 is a block diagram of an example audio processing system 210. The audio processing system 210 may provide additional information for the audio processing system of FIG. 2. The audio processing system 210 may include a noise reduction module 310, a frequency analysis module 320, a comparing module 330, a reconstruction module 340, and a memory storing a code book 350.

Figure 4A:
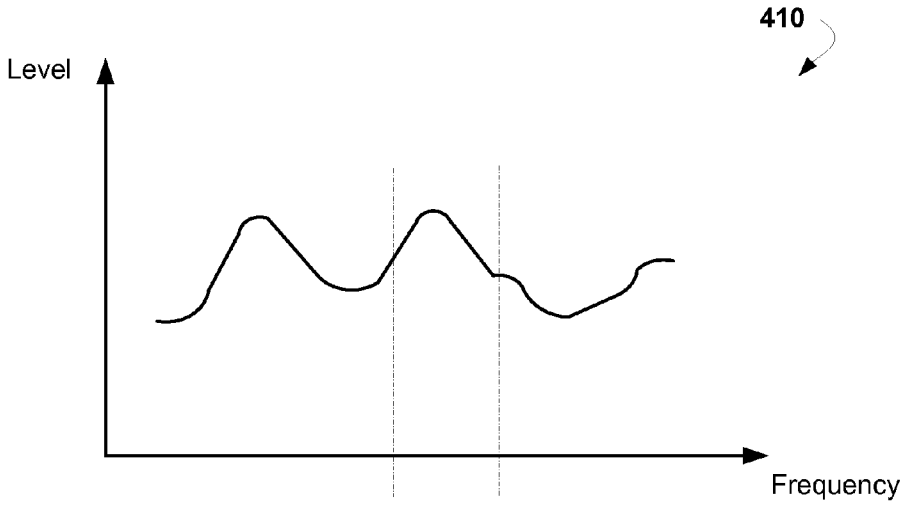
FIG. 4A depicts an example frequency spectrum of an audio signal sample before the noise reduction according to various embodiments.
Figure 4B:
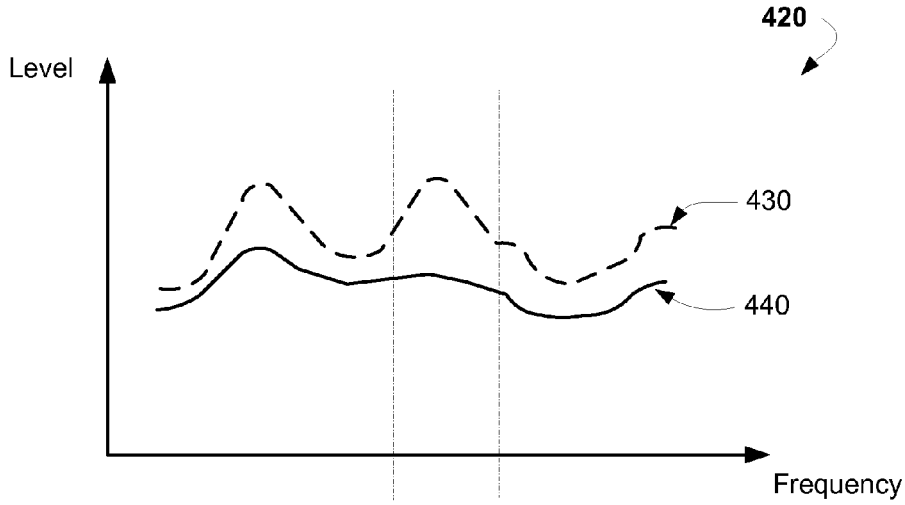
FIG. 4B shows an example frequency spectrum of an audio signal sample after the noise reduction according to various embodiments.

In operation, the audio processing system 210 may receive an audio signal including one or more time-domain input signals and provide the input signals to the noise reduction module 310. The noise reduction module 310 may include multiple modules and may perform noise reduction such as subtractive noise cancellation or multiplicative noise suppression, and provide a transformed, noise-suppressed signal. These principles are further illustrated in FIGS. 4A and 4B, which show an example frequency spectrum 410 of audio signal sample before the noise reduction and an example frequency spectrum 420 of audio signal sample after the noise reduction, respectively. As shown in FIG. 4B, the noise reduction process may transform frequencies of the initial audio signal (shown as a dashed line in FIG. 4B and undashed in FIG. 4A) to a noise-suppressed signal (shown as a solid line), whereas one or more speech parts may be eliminated or excessively attenuated.

An example system for implementing noise reduction is described in more detail in U.S. patent application Ser. No. 12/832,920, "Multi-Microphone Robust Noise Suppression," filed on Jul. 8, 2010, the disclosure of which is incorporated herein by reference.

Figure 4C:
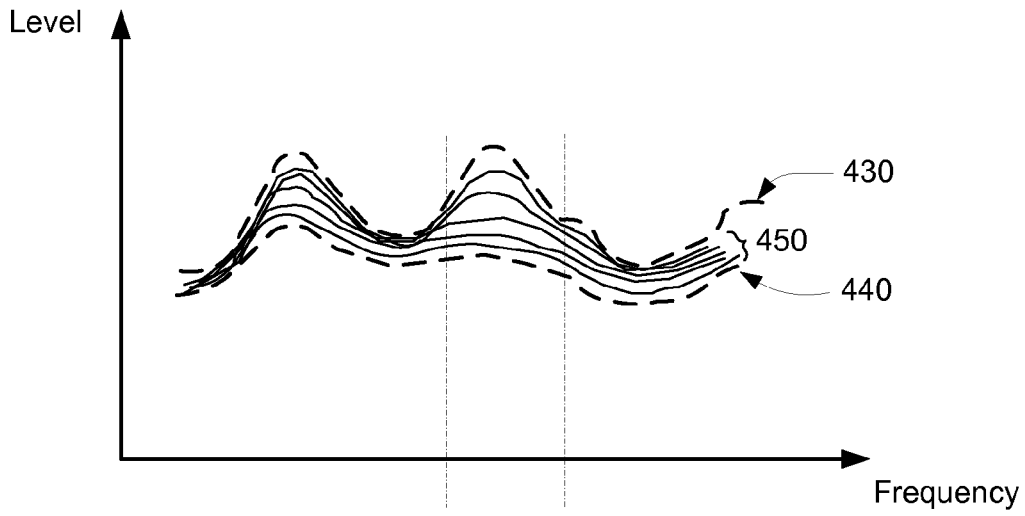
FIG. 4C shows example frequency spectrums of audio signal sample before and after the noise reduction and also a plurality of frequency spectrum interpolations.

With continuing reference to FIG. 3, the frequency analysis module 320 may receive both the initial, not-transformed audio signal and the transformed, noise-suppressed audio signal and calculate or determine their corresponding spectrum envelopes 430 and 440 before or after noise reduction, respectively. Furthermore, the frequency analysis module 320 may calculate a plurality of interpolated versions of the frequency spectrum between the spectrum envelopes 430 and 440. FIG. 4C shows example frequency spectrum envelopes 430 and 440 of audio signal sample before and after the noise reduction (shown as dashed lines) and also a plurality of frequency spectrum interpolations 450. The interpolations 450 may also be referred to as "prototypes."

With continuing reference to FIG. 3, the comparing module 330 may further analyze the plurality of frequency spectrum interpolations 450 and compare them to predefined spectral envelopes associated with clean reference speech signals. Based on the result of this comparison, one of the interpolations 450 (the closest or the most similar to one of the predetermined reference spectral envelopes) may be selected.

Specifically, the frequency analysis module 320 or the comparing module 330 may calculate corresponding LSF coefficients for every interpolation 450. The LSF coefficients may then be compared by the comparing module 330 to multiple reference coefficients associated with the clean reference speech signals, which may be stored in the code book 350. The reference coefficients may relate to LSF coefficients derived from the clean reference speech signals. The reference coefficients may optionally be generated by utilizing a vector quantizer. The comparing module 330 may then select one of the LSF coefficients which is the closest or the most similar to one of the reference LSF coefficients stored in the code book 350.

Figure 4D:
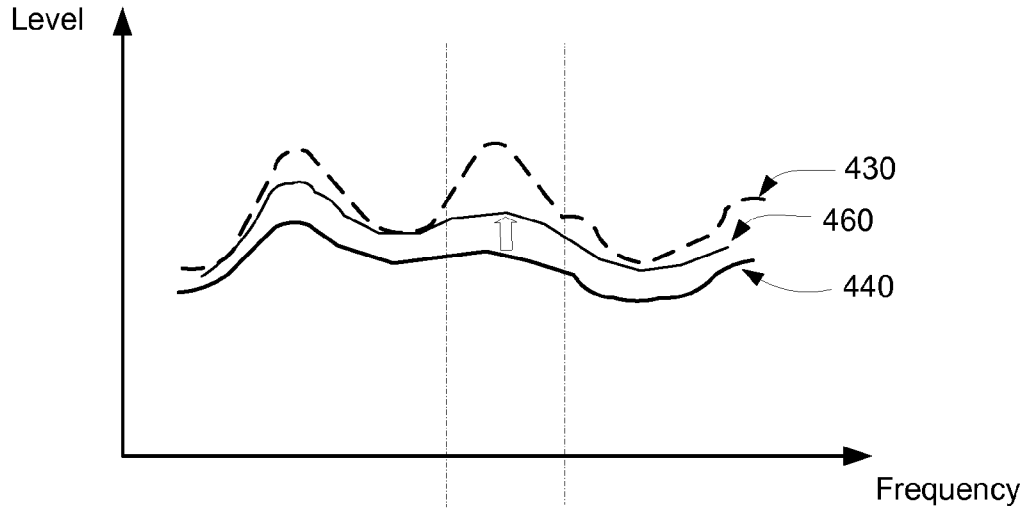
FIG. 4D shows example frequency spectrums of an audio signal sample before and after the noise reduction procedure and also shows the selected frequency spectrum interpolation.

With continuing reference to FIG. 3, the reconstruction module 340 may receive an indication of the selected interpolation (or selected LSF coefficient) and reconstruct the transformed audio signal spectrum envelope 440, at least in part, to the levels of selected interpolation. FIG. 4D shows an example process for reconstruction of the transformed audio signal as described above. In particular, FIG. 4D shows example frequency spectrum envelopes 430 and 440 of audio signal sample before and after the noise reduction procedure. FIG. 4D also shows the selected frequency spectrum interpolation 460. The arrow of the FIG. 4D demonstrates the modification process of the transformed audio signal spectrum envelope 440.

Figure 5:
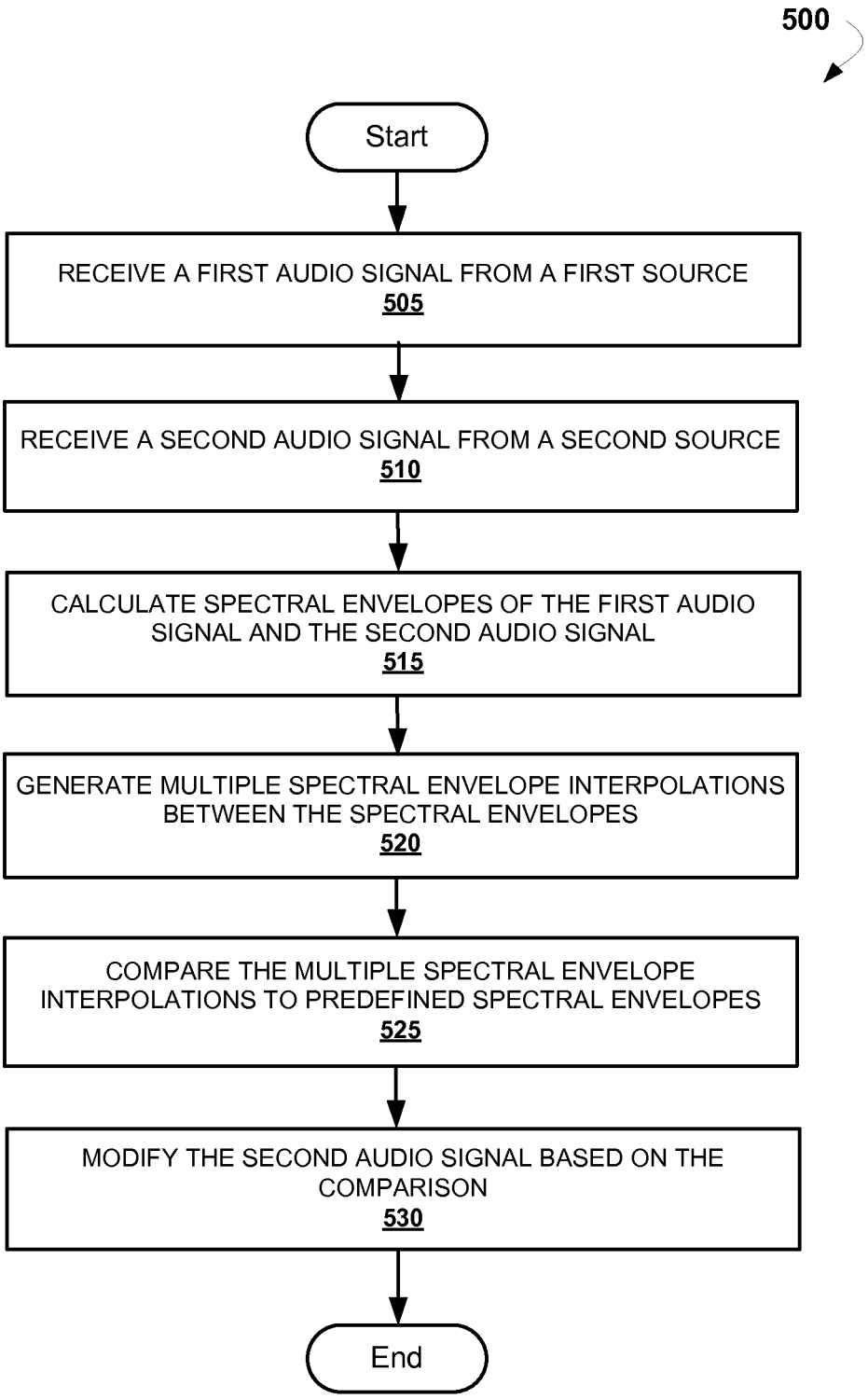
FIG. 5 illustrates a flow chart of an example method for audio processing according to various embodiments.

FIG. 5 illustrates a flow chart of an example method 500 for audio processing. The method 500 may be practiced by the audio device 104 and its components as described above with references to FIGS. 1-3.

The method 500 may commence in operation 505 as a first audio signal is received from a first source, such as the primary microphone 106. In operation 510, a second audio signal may be received from a second source, such as the noise reduction module 310. The first audio signal may include a non-transformed, initial audio signal, while the second audio signal may include a transformed, noise-suppressed first audio signal.

In operation 515, spectral or spectrum envelopes 430 and 440 of the first audio signal and the second audio signal may be calculated or determined by the frequency analysis module 320. Spectral is also referred to herein as spectrum. In operation 520, multiple spectral (spectrum) envelope interpolations 450 between of the spectral envelopes 430 and 440 may be determined.

In operation 525, the comparing module 330 may compare the multiple spectral envelope interpolations 450 to predefined spectral envelopes stored in the code book 350. The comparing module 330 may then select one of the multiple spectral envelope interpolations 450, which is the most similar to one of the multiple predefined spectral envelopes.

In operation 530, the reconstruction module 340 may modify the second audio signal based in part on the comparison. In particular, the reconstruction module 340 may reconstruct at least a part of the second signal spectral envelope 440 to the levels of the selected interpolation.

Figure 6:
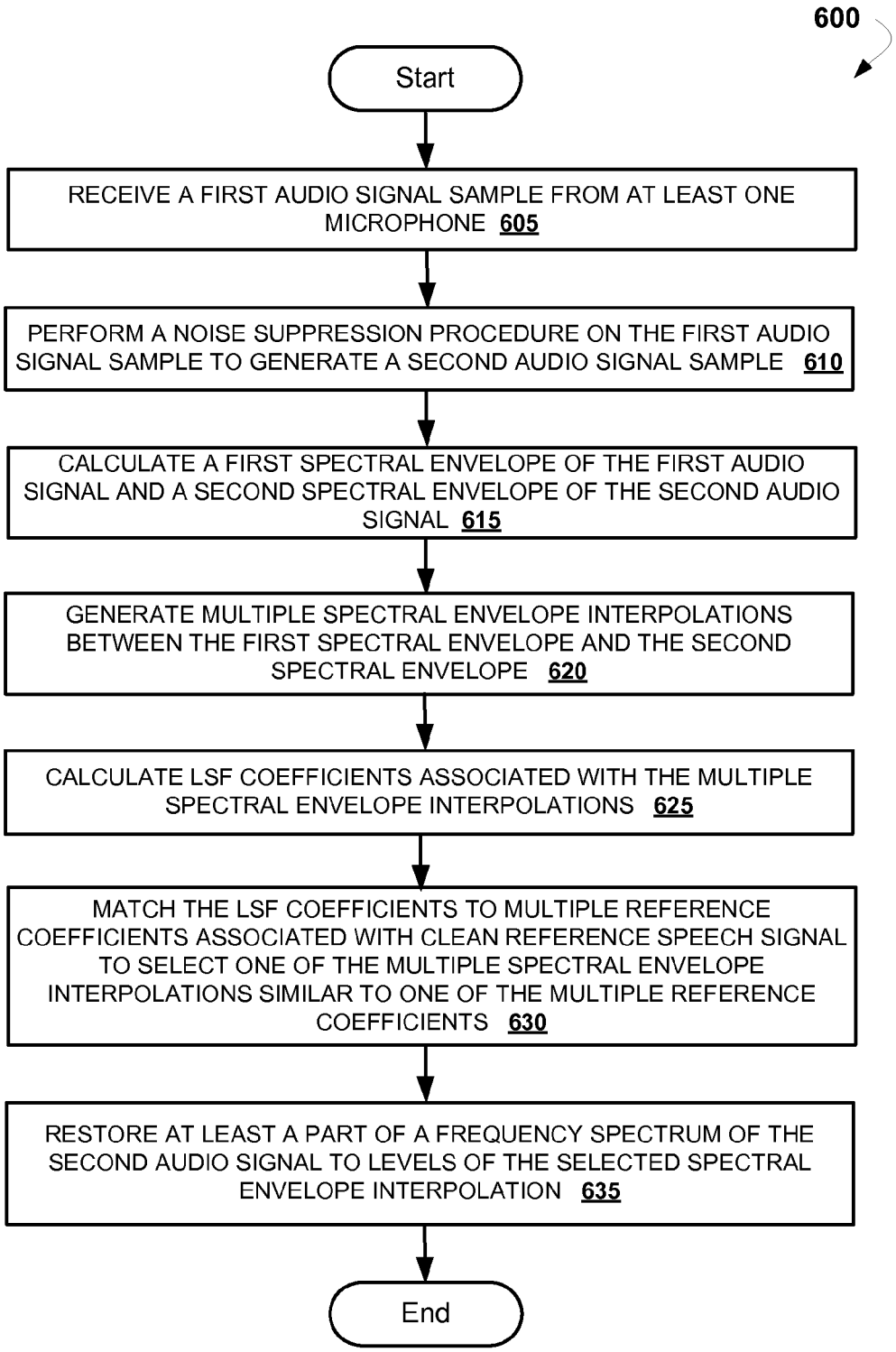
FIG. 6 illustrates a flow chart of another example method for audio processing according to various embodiments.

FIG. 6 illustrates a flow chart of another example method 600 for audio processing. The method 600 may be practiced by the audio device 104 and its components as described above with references to FIGS. 1-3.

The method 600 may commence in operation 605 with receiving a first audio signal sample from at least one microphone (e.g., primary microphone 106). In operation 610, noise reduction module 310 may perform a noise suppression procedure and/or noise cancellation procedure to the first audio signal sample to generate a second audio signal sample.

In operation 615, the frequency analysis module 320 may calculate (define) a first spectral envelope of the first audio signal and a second spectral envelope of the second audio signal. In operation 620, the frequency analysis module 320 may generate multiple spectral envelope interpolations between the first spectral envelope and the second spectral envelope.

In operation 625, the frequency analysis module 320 may calculate LSF coefficients associated with the multiple spectral envelope interpolations. In operation 630, the comparing module 330 may match the LSF coefficients to multiple reference coefficients associated with clean reference speech signal and select one of the multiple spectral envelope interpolations which is the most similar to one of the multiple reference coefficients stored in the code book 350.

In some embodiments of operations 620 and 625, rather than interpolating the actual spectra, operations 620 and 625 are modified such that the spectral envelopes are first converted to LSF coefficients, and then the multiple spectral envelope interpolations are generated. The spectral envelopes may first be obtained through Linear Predictive Coding (LPC) and then transformed to LSF coefficients, the LSF coefficients having adequate interpolation properties.

In operation 635, the reconstruction module 340 may restore at least a part of a frequency spectrum of the second audio signal to levels of the selected spectral envelope interpolation. The restored second audio signal may further be outputted or transmitted to another device.

Figure 7:
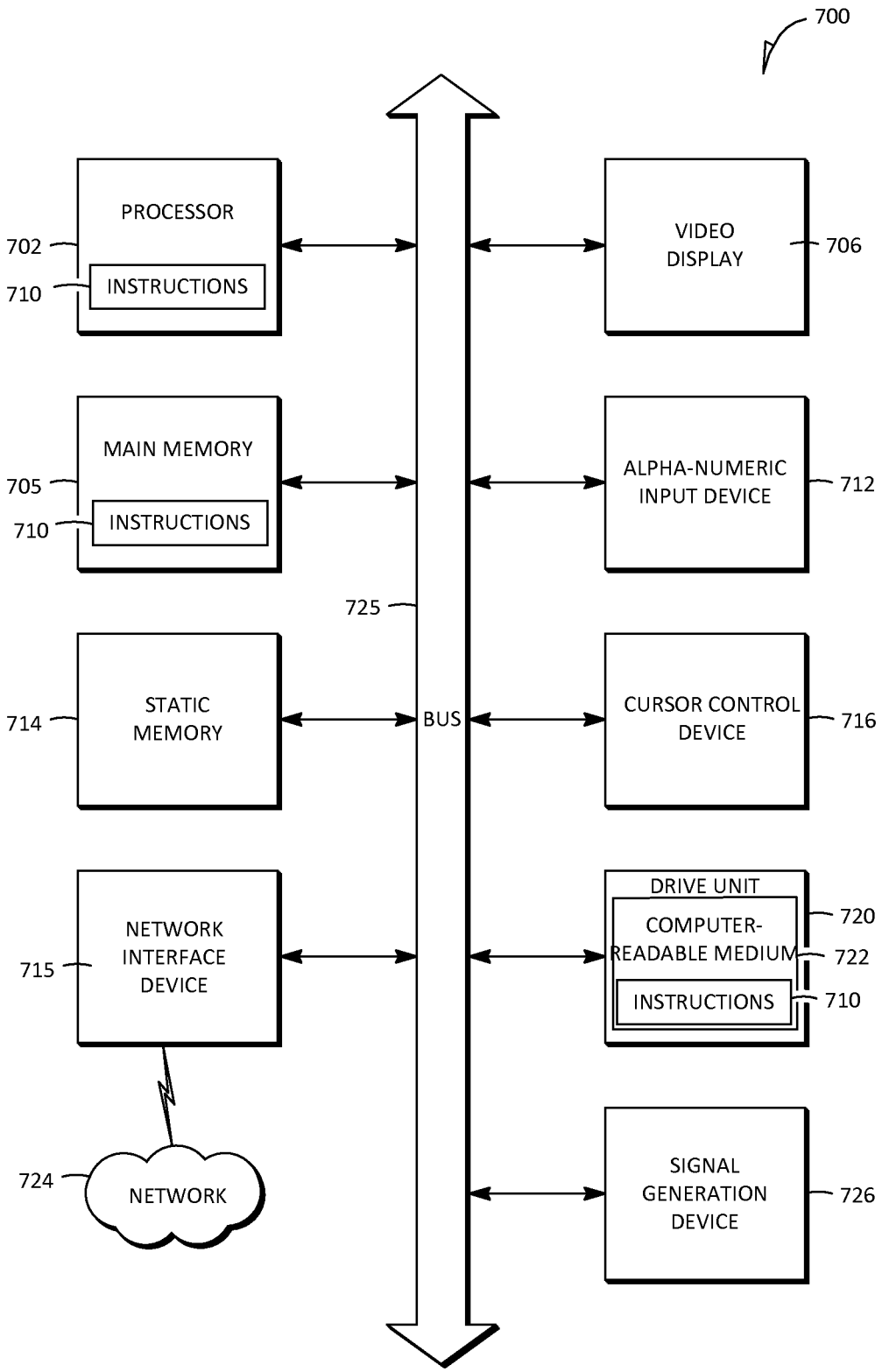
FIG. 7 is a diagrammatic representation of an example machine in the form of a computer system, within which a set of instructions for causing the machine to perform any one or more of the methodologies discussed herein may be executed.

FIG. 7 is a diagrammatic representation of an example machine in the form of a computer system 700, within which a set of instructions for causing the machine to perform any one or more of the methodologies discussed herein may be executed. In various example embodiments, the machine operates as a standalone device or may be connected (e.g., networked) to other machines. In a networked deployment, the machine may operate in the capacity of a server or a client machine in a server-client network environment, or as a peer machine in a peer-to-peer (or distributed) network environment. The machine may be a personal computer (PC), a tablet PC, phablet device, a set-top box (STB), a Personal Digital Assistant (PDA), a cellular telephone, a portable music player (e.g., a portable hard drive audio device such as an Moving Picture Experts Group Audio Layer 3 (MP3) player), a web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 700 includes a processor or multiple processors 702 (e.g., a central processing unit (CPU), a graphics processing unit (GPU), or both), and a main memory 705 and static memory 714, which communicate with each other via a bus 725. The computer system 700 may further include a video display unit 706 (e.g., a liquid crystal display (LCD)). The computer system 700 may also include an alpha-numeric input device 712 (e.g., a keyboard), a cursor control device 716 (e.g., a mouse), a voice recognition or biometric verification unit, a drive unit 720 (also referred to as disk drive unit 720 herein), a signal generation device 726 (e.g., a speaker), and a network interface device 715. The computer system 700 may further include a data encryption module (not shown) to encrypt data.

The disk drive unit 720 includes a computer-readable medium 722 on which is stored one or more sets of instructions and data structures (e.g., instructions 710) embodying or utilizing any one or more of the methodologies or functions described herein. The instructions 710 may also reside, completely or at least partially, within the main memory 705 and/or within the processors 702 during execution thereof by the computer system 700. The main memory 705 and the processors 702 may also constitute machine-readable media.

The instructions 710 may further be transmitted or received over a network 724 via the network interface device 715 utilizing any one of a number of well-known transfer protocols (e.g., Hyper Text Transfer Protocol (HTTP)).

While the computer-readable medium 722 is shown in an example embodiment to be a single medium, the term "computer-readable medium" should be taken to include a single medium or multiple media (e.g., a centralized or distributed database and/or associated caches and servers) that store the one or more sets of instructions. The term "computer-readable medium" shall also be taken to include any medium that is capable of storing, encoding, or carrying a set of instructions for execution by the machine and that causes the machine to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, and carrier wave signals. Such media may also include, without limitation, hard disks, floppy disks, flash memory cards, digital video disks, random access memory (RAM), read only memory (ROM), and the like.

The example embodiments described herein may be implemented in an operating environment comprising software installed on a computer, in hardware, or in a combination of software and hardware.

The present technology is described above with reference to example embodiments. It will be apparent to those skilled in the art that various modifications may be made and other embodiments can be used without departing from the broader scope of the present technology. For example, embodiments of the present invention may be applied to any system (e.g., a non-speech enhancement system or acoustic echo cancellation system).

What is claimed is:

1. A method for audio processing, the method comprising:

receiving, by one or more processors, a first audio signal from a first source;

receiving, by the one or more processors, a second audio signal from a second source;

calculating, by the one or more processors, a first spectral envelope of the first audio signal and a second spectral envelope of the second audio signal;

generating, by the one or more processors, multiple spectral envelope interpolations between the first and second spectral envelopes;

comparing, by the one or more processors, the multiple spectral envelope interpolations to predefined spectral envelopes; and based at least in part on the comparison, selectively modifying, by the one or more processors, the second audio signal.

2. The method of claim 1, wherein the first audio signal and the second audio signal include a speech signal.

3. The method of claim 1, wherein the second audio signal includes a modified version of the first audio signal.

4. The method of claim 3, wherein the second audio signal includes the first audio signal subjected to a noise-suppression or a noise cancellation process.

5. The method of claim 1, wherein the multiple spectral envelope interpolations are generated for a first sample of the first audio signal and a second sample of the second audio signal, the first sample and the second sample being taken at substantially the same time.

6. The method of claim 1, wherein the generating of the multiple spectral envelope interpolations includes calculating, by the one or more processors, multiple line spectral frequencies (LSF) coefficients.

7. The method of claim 6, wherein the comparing of the multiple spectral envelope interpolations to predefined spectral envelopes includes matching the LSF coefficients to multiple reference coefficients associated with clean reference speech.

8. The method of claim 7, further comprising determining, by the one or more processors, the most similar spectral envelope interpolation among the multiple spectral envelope interpolations of the predefined spectral envelopes.

9. The method of claim 8, wherein the determining of the most similar spectral envelope interpolation includes:

applying, by the one or more processors, a weight function to the LSF coefficients; and selecting, by the one or more processors, one of the multiple spectral envelope interpolations having the LSF coefficient with the lowest weight with respect to at least one of the multiple reference coefficients associated with clean speech.

10. The method of claim 9, wherein the selectively modifying of the second audio signal includes reconfiguring, by the one or more processors, at least a part of a frequency spectrum of the second audio signal to levels of the selected spectral envelope interpolation.

11. A non-transitory processor-readable medium having embodied thereon instructions being executable by at least one processor to perform a method for audio processing, the method comprising:

receiving a first audio signal from a first source;

receiving a second audio signal from a second source;

calculating a first spectral envelope of the first audio signal and a second spectral envelope of the second audio signal;

generating multiple spectral envelope interpolations between the first and second spectral envelopes;

comparing the multiple spectral envelope interpolations to predefined spectral envelopes; and based at least in part on the comparison, selectively modifying the second audio signal.

12. The non-transitory processor-readable medium of claim 11, wherein the first audio signal and the second audio signal include a speech signal.

13. The non-transitory processor-readable medium of claim 11, wherein the second audio signal includes a modified version of the first audio signal.

14. The non-transitory processor-readable medium of claim 13, wherein the second audio signal includes the first audio signal subjected to a noise-suppression or noise cancellation process.

15. The non-transitory processor-readable medium of claim 11, wherein the multiple spectral envelope interpolations are generated for a first sample of the first audio signal and a second sample of the second audio signal, wherein the first sample and the second sample are taken at substantially the same time.

16. The non-transitory processor-readable medium of claim 11, wherein the generating of the multiple spectral envelope interpolations includes calculating multiple line spectral frequencies (LSF) coefficients.

17. The non-transitory processor-readable medium of claim 16, wherein the comparing of the multiple spectral envelope interpolations to predefined spectral envelopes includes matching the LSF coefficients to multiple reference coefficients associated with clean reference speech.

18. The non-transitory processor-readable medium of claim 17, further comprising determining the most similar spectral envelope interpolation among the multiple spectral envelope interpolations of the predefined spectral envelopes.

19. The non-transitory processor-readable medium of claim 18, wherein the determining of the most similar spectral envelope interpolation includes:

applying a weight function to the LSF coefficients; and selecting one of the multiple spectral envelope interpolations having the LSF coefficient with the lowest weight with respect to at least one of the multiple reference coefficients associated with clean speech.

20. The non-transitory processor-readable medium of claim 19, wherein the selectively modifying of the second audio signal includes reconfiguring at least a part of a frequency spectrum of the second audio signal to levels of the selected spectral envelope interpolation.

21. A system for processing an audio signal, the system comprising:

a frequency analysis module stored in a memory and executable by a processor, the frequency analysis module being configured to generate multiple spectral envelope interpolations between spectral envelopes related to a first audio signal and a second audio signal, wherein the second audio signal includes the first audio signal subjected to a noise-suppression procedure;

a comparing module stored in the memory and executable by the processor, the comparing module being configured to compare the multiple spectral envelope interpolations to predefined spectral envelopes stored in the memory; and a reconstruction module stored in the memory and executable by the processor, the reconstruction module being configured to modify the second audio signal based at least in part on the comparison.

22. The system of claim 21, wherein the first audio signal includes a speech signal captured by at least one microphone.

23. The system of claim 21, wherein the multiple spectral envelope interpolations are generated for a first sample of the first audio signal and a second sample of the second audio signal, wherein the first sample and the second sample are taken at substantially the same time.

24. The system of claim 21, wherein the generation of the multiple spectral envelope interpolations includes calculation of multiple line spectral frequencies (LSF) coefficients.

25. The system of claim 24, wherein the comparing of the multiple spectral envelope interpolations to predefined spectral envelopes includes matching the LSF coefficients to multiple reference coefficients associated with clean reference speech.

26. The system of claim 25, wherein the comparing module is further configured to determine one of the multiple spectral envelope interpolations which are the most similar to one of the predefined spectral envelopes.

27. The system of claim 26, wherein the comparing module is further configured to apply a weight function to the LSF coefficients.

28. The system of claim 27, wherein the comparing module is further configured to select one of the multiple spectral envelope interpolations having the LSF coefficient with the lowest weight with respect to at least one of the multiple reference coefficients associated with clean reference speech.

29. The system of claim 28, wherein the modifying of the second audio signal includes restoring at least a part of a frequency spectrum of the second audio signal to levels of the selected spectral envelope interpolation.

30. A method for audio processing, the method comprising:

receiving, by one or more processors, a first audio signal sample from at least one microphone;

performing, by the one or more processors, a noise suppression procedure to the first audio signal sample to generate a second audio signal sample;

calculating, by the one or more processors, a first spectral envelope of the first audio signal and a second spectral envelope of the second audio signal;

calculating, by the one or more processors, respective line spectral frequencies (LSF) coefficients for the first and second spectral envelopes;

generating, by the one or more processors, multiple spectral envelope interpolations between the LSF coefficients for the first spectral envelope and the LSF coefficients for the second spectral envelope;

matching, by the one or more processors, the interpolated LSF coefficients to multiple reference coefficients associated with a clean reference speech signal to select one of the multiple spectral envelope interpolations which is the most similar to one of the multiple reference coefficients; and restoring, by the one or more processors, at least a part of a frequency spectrum of the second audio signal to levels of the selected spectral envelope interpolation.

* * * * *